US011016447B2

(12) United States Patent
Zanesco et al.

(10) Patent No.: US 11,016,447 B2
(45) Date of Patent: May 25, 2021

(54) CONTROL DEVICE EQUIPPED WITH A MODULE FOR DETECTING THE AXIAL POSITION OF ITS ROD, AND TIMEPIECE COMPRISING SUCH A CONTROL DEVICE

(71) Applicant: ETA SA Manufacture Horlogere Suisse, Grenchen (CH)

(72) Inventors: Vittorio Zanesco, Neuchatel (CH); Michael Canonica, St-Blaise (CH); Roger Mueller, Schoenbuehl (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 413 days.

(21) Appl. No.: 16/167,612

(22) Filed: Oct. 23, 2018

(65) Prior Publication Data

US 2019/0121299 A1 Apr. 25, 2019

(30) Foreign Application Priority Data

Oct. 23, 2017 (EP) ..... 17197847

(51) Int. Cl.

| | |
|---|---|
| ***G04G 21/00*** | (2010.01) |
| ***H01H 25/06*** | (2006.01) |
| ***G04C 3/00*** | (2006.01) |

(52) U.S. Cl.

CPC ..... *G04G 21/00* (2013.01); *G04C 3/005* (2013.01); *H01H 25/06* (2013.01); *H01H 2221/036* (2013.01); *H01H 2231/028* (2013.01)

(58) Field of Classification Search

CPC ..... G04G 21/00; G04G 9/087; G04C 3/005; G04C 3/001; G04C 3/007; G04C 9/04; H01H 25/06; H01H 2221/036; H01H 2231/028; G04B 37/106; G04F 10/04

USPC ..... 368/321

See application file for complete search history.

(56) References Cited

U.S. PATENT DOCUMENTS

| | | | | |
|---|---|---|---|---|
| 4,034,551 A | | 7/1977 | Ushiyama | |
| 4,536,095 A | | 8/1985 | Wuthrich et al. | |
| 5,508,978 A | * | 4/1996 | Kalbermatter | G04G 21/00 368/13 |

(Continued)

OTHER PUBLICATIONS

European Search Report dated Apr. 24, 2018 in European Application 17197847.1, filed on Oct. 23, 2017 (with English Translation of Categories of Cited Documents).

*Primary Examiner* — Edwin A. Leon

(74) *Attorney, Agent, or Firm* — Oblon, McClelland, Maier & Neustadt, L.L.P.

(57) ABSTRACT

A detector includes an elastic conductive blade having first and second ends and a central portion therebetween, with the blade being designed to be driven axially by a control rod to occupy three distinct positions between the pulled position and the end position of the rod: a pulled position, an end position, and an intermediate position. Two electrical contacts are designed to detect the end position and the pulled position of the rod, respectively. The blade is designed to pivot at its first end when the rod passes from the intermediate position to the pulled position, or vice versa. The blade is designed to undergo elastic deformation when the rod passes between the intermediate position and the end position so as to participate substantially in a restoring force of the rod toward the intermediate position when the axial activating force applied to the rod by a user is released.

12 Claims, 3 Drawing Sheets

(56) References Cited

U.S. PATENT DOCUMENTS

| | | | | |
|---|---|---|---|---|
| 6,896,403 | B1 | 5/2005 | Grau | |
| 7,111,979 | B2 * | 9/2006 | Kaelin | G04C 3/005 368/308 |
| 10,768,577 | B2 * | 9/2020 | Lagorgette | G04B 27/002 |

* cited by examiner

CONTROL DEVICE EQUIPPED WITH A MODULE FOR DETECTING THE AXIAL POSITION OF ITS ROD, AND TIMEPIECE COMPRISING SUCH A CONTROL DEVICE

This application claims priority from European Patent Application No. 17197847.1 filed on Oct. 23, 2017; the entire disclosure of which is incorporated herein by reference.

TECHNICAL FIELD

The invention relates to a control device comprising a rod that can be actuated by a user and a module of the electric type for detecting the axial position of the rod that forms a push-crown of a timepiece, for example. In particular, the detection module is designed to also enable a rotational movement of the rod to be detected.

TECHNOLOGICAL BACKGROUND

In timepieces having electronic-type push-crowns associated with electric modules for detecting the axial position of their rod, these electric modules are generally bulky and often allow only two positions to be detected: a rest position that is stable and an end position for a push function, also called a 'click position.' Known detection modules are generally large in size and can often only detect two axial positions of the rod. Another drawback of known detection modules is that they generally have rather weak rod return means for ensuring the return of the rod following activation of the push function.

SUMMARY OF THE INVENTION

The object of the present invention is to overcome at least some of the drawbacks identified above in connection with the electrical-type detection modules that are arranged particularly in timepieces for detecting at least the axial position of a rod of a control device.

For this purpose, the invention proposes a control device that is designed to detect several axial positions of its rod according to claim 1.

The detection module according to the invention was developed in order to reduce its size so as to enable it to be integrated into smaller calibers (for watches) while enabling three axial positions of the rod to be detected. In order to save space, the blade acts as an electrical contactor for detecting the axial position in addition to having the function of a return spring for the click position. Moreover, the design of the detection module allows for a traditional method of casing because it can be completely integrated into the movement of a timepiece.

The invention also relates to a timepiece comprising the aforementioned control device.

Other aspects of the present invention are set out in the dependent claims.

BRIEF DESCRIPTION OF THE FIGURES

The invention will be described hereinafter in greater detail with the aid of the accompanying drawings, given by way of non-limiting examples, in which.

DETAILED DESCRIPTION OF THE INVENTION

An embodiment according to the present invention will now be explained in more detail with reference to the figures. This embodiment will be described in the context of a timepiece. In the present detailed description, the timepiece is a wristwatch in particular and referred to hereinafter simply as "watch," but the present invention is not limited to watches worn on a user's wrist. In fact, the present invention can be applied to any type of electronic timepiece or other portable electronic devices equipped with a device for controlling at least some of their functions.

Figure 1:
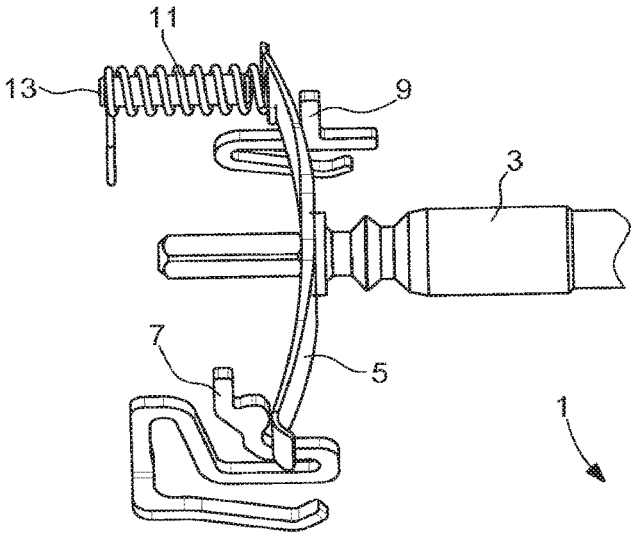
FIG. 1 is a perspective view showing main elements of the module for detecting the axial position of a control rod according to an embodiment of the present invention.

FIG. 1 shows, in perspective, the main elements of the electrical system for detecting the axial position of a rod 3 of a push-crown of a watch. This detection system comprises a curved elastic conductive blade 5, also called 'crossbow' because of its shape. The blade 5 thus has a substantially crossbow shape when it is viewed from above and is not being subjected to any external force. In this example, the blade is made of maraging steel, which is an alloy known for its high strength and hardness while maintaining good ductility. The blade 5 comprises a first end, a second end opposite the first end, and a central portion between the first end and the second end. The blade 5 comprises a first intermediate portion between the central portion and the first end, and a second intermediate portion between the central portion and the second end.

Figure 2:
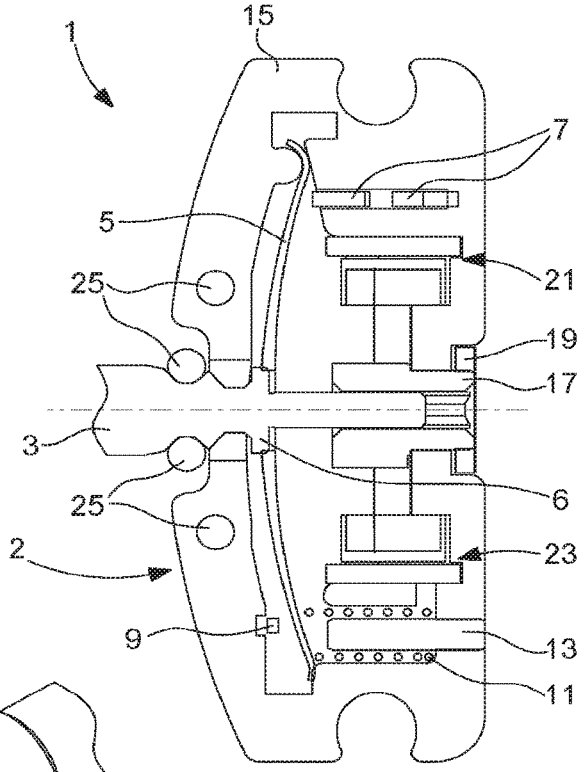
FIG. 2 is a horizontal sectional view of the control device according to the invention illustrating the main elements of FIG. 1 placed inside a frame of the detection module.

A through hole is provided in the central portion of the blade 5 so that the end portion of the rod 3 can pass partially through the blade, which abuts against a shoulder 6 provided on the rod 3, as shown in FIG. 2. The rod 3 defines a longitudinal axis, so that the blade is arranged with its central portion substantially perpendicular to this longitudinal axis and is driven axially by this rod during axial displacements toward an end position. The blade 5 is arranged in the detection module such that, in a non-deformed state, its central portion is situated in projection on the longitudinal axis of the rod 3 on the side of the pulled position relative to its first and second ends. Advantageously, the conductive blade has a variable cross section that decreases from its center, i.e., the central portion, toward its two ends. The advantage of this non-constant cross section will be explained later.

The detection system also comprises a first electrical contact 7, located substantially at the first end of the blade 5, and a second electrical contact 9, located substantially at the second end of the blade 5, which are arranged so as to selectively come into contact with the blade, as will be explained below. The first electrical contact 7 is provided on a first side of the blade, while the second electrical contact 9 is provided on a second side of the blade 5—that is, on the side opposite the first side. A return spring 11, mounted around a guide member 13, such as a pin, is arranged in abutment against the first side of the blade on the side of the second end of this blade. It is designed to be in permanent contact with the blade. The return spring 11 has two functions, namely a mechanical function and an electrical function for applying an electric potential to the blade 5. The blade 5 can be grounded through the return spring, for example. The blade 5, the first and second electrical contacts 7, 9, and the return spring 11 are therefore all electrical conductors. They can be made of a conductive material or have a conductive outer layer. The return spring 11 is made of steel, for example.

FIG. 2 is a horizontal sectional view showing the control device 1 according to the invention with elements of the abovementioned detection system inside a frame 15 forming together a detection module 2. This detection module comprises two optical sensors 21 and 23 that are associated with a sliding pinion 17 driven in rotation by the end portion, of non-circular cross section, of the rod 3. The sliding pinion 17 is retained axially by a washer 19 and has reflective facets. Such a system for detecting the rotation of a rod will not be described here in further detail. It is known to those skilled in the art. Note that a magnetic or capacitive detection system can also be provided. In the case of a magnetic system, the sliding pinion carries a magnet.

Figure 3:
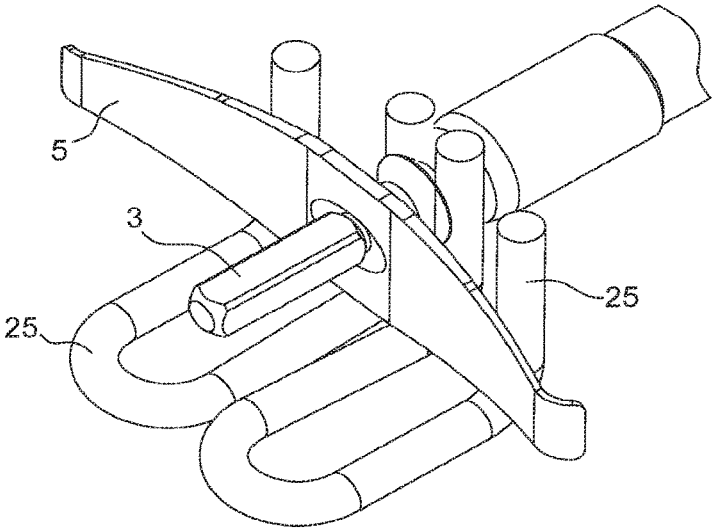
FIG. 3 is an isometric view illustrating the rod between two springs positioning of the rod and the elastic blade associated therewith.
Figure 4:
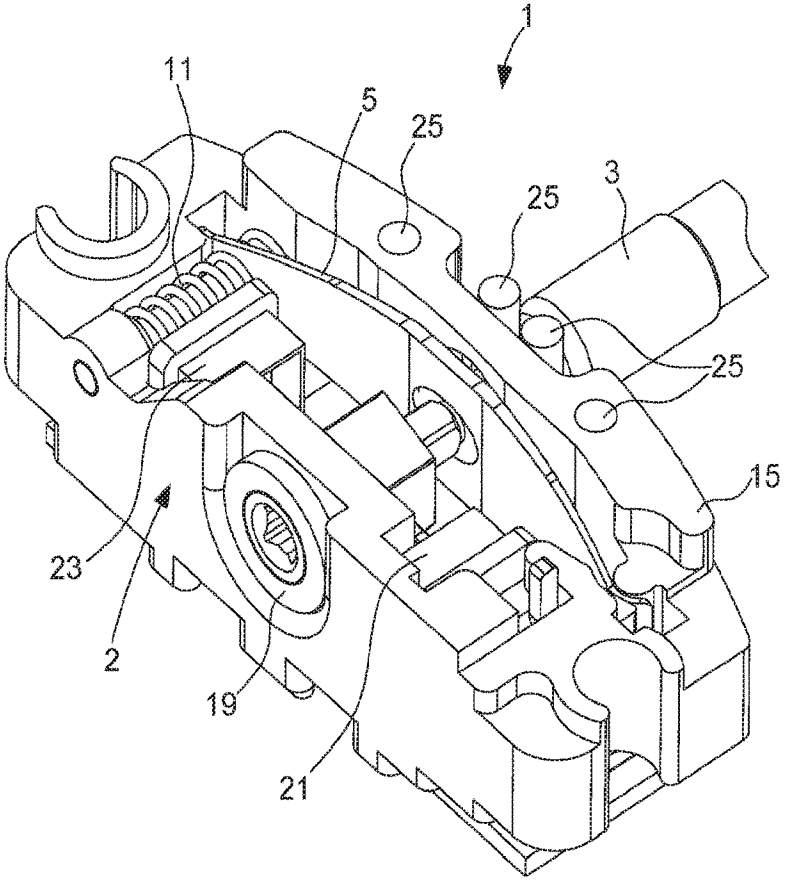
FIG. 4 is an isometric view of the control device of FIG. 2.

Two springs 25 are also provided for axially positioning the rod 3. These two springs are better illustrated in FIG. 3. For its axial positioning, the rod 3 conventionally comprises two transverse grooves that are arranged so as to engage with these two springs, which exert a transverse pressure on the rod. The rod can thus occupy two stable axial positions. Upstream of the two grooves, the rod has a tapered section to facilitate the intended push function. Advantageously, the rod 3 is retained and thus guided only by the sliding pinion 17 and a middle part of the watch case (not shown). This aspect helps to minimize the bulk of the proposed solution. The isometric view of FIG. 4 illustrates the control device 1 and, in particular, the detection module 2.

Figure 5A:
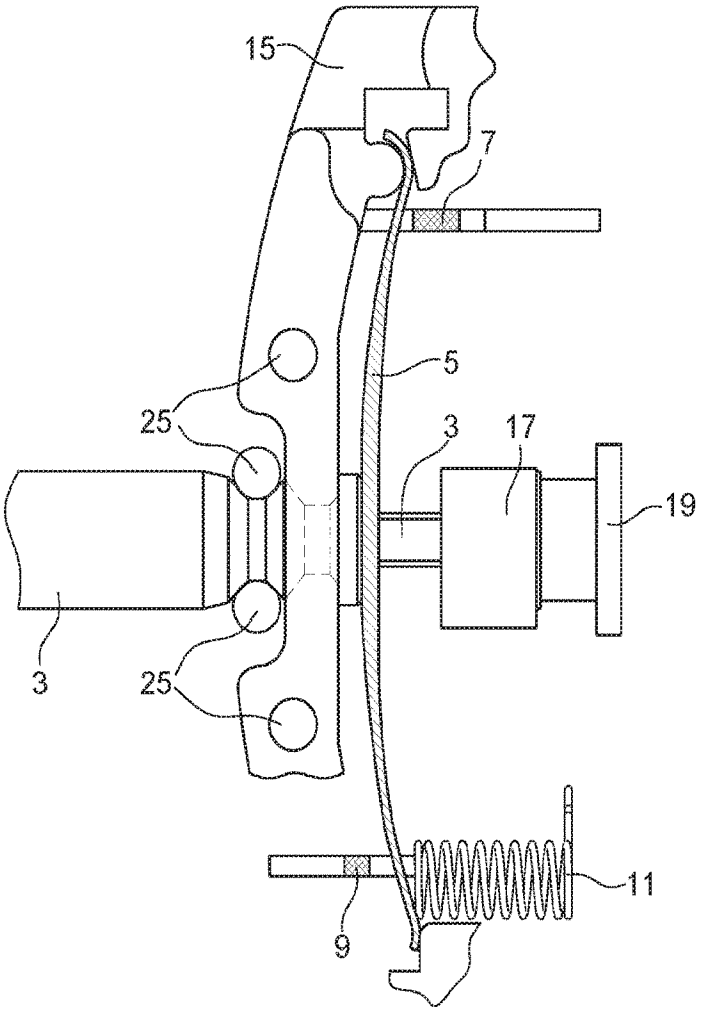
FIGS. 5*a*, 5*b*, and 5*c* are partial top views illustrating three different configurations of the control device that respectively correspond to three different positions of the rod detected by the detection module.
Figure 5C:
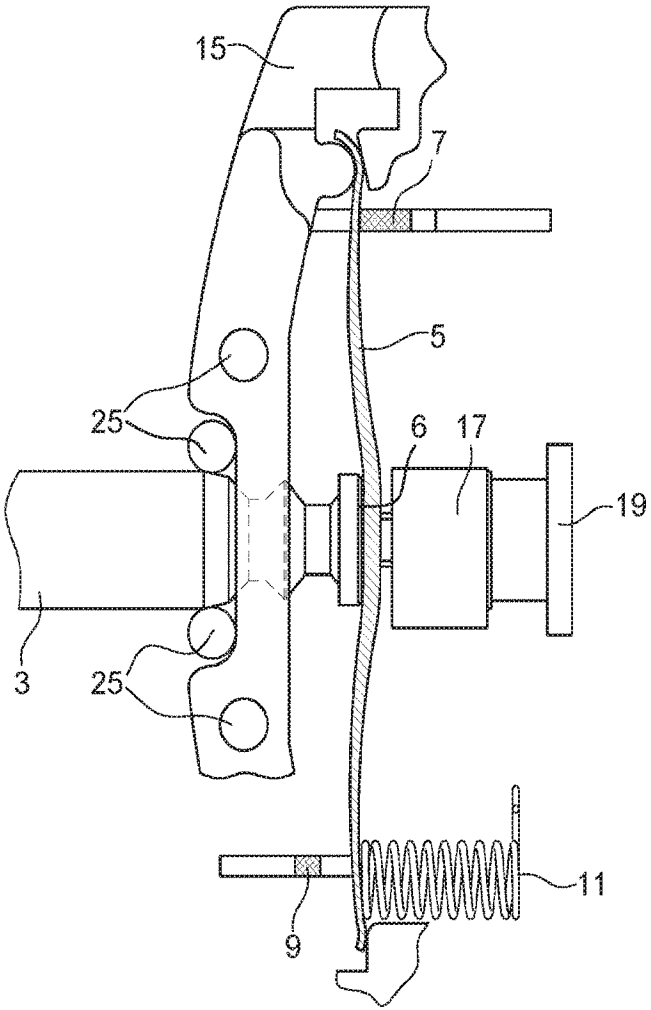
Figure 5B:
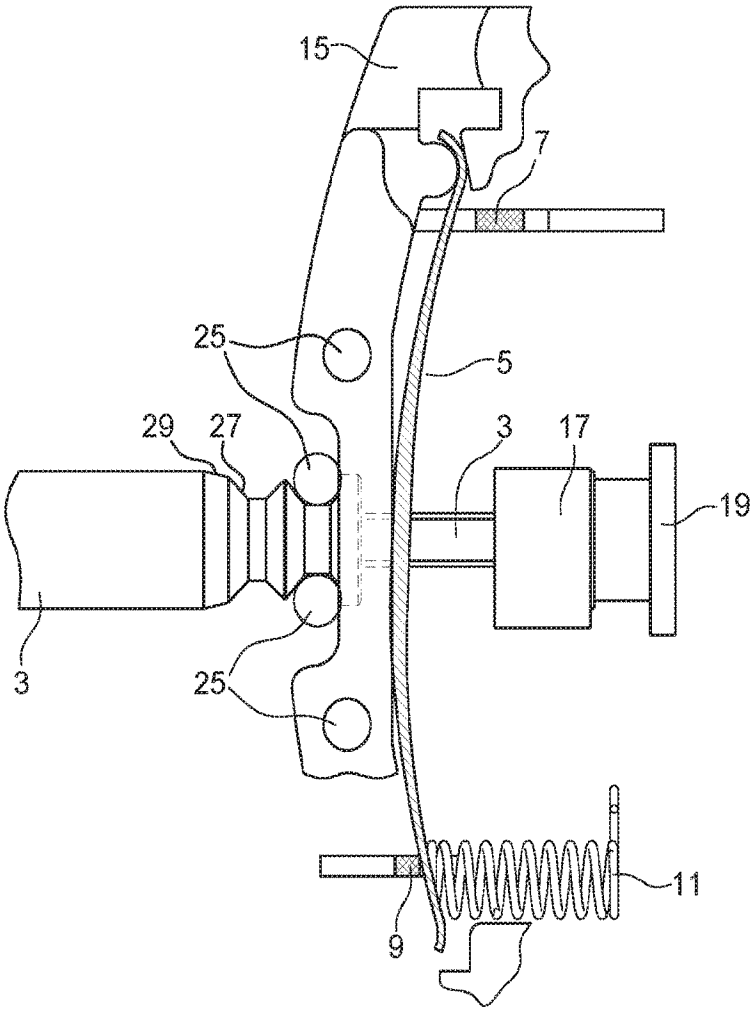

With reference to FIGS. 5*a* to 5*c*, the indexing of the rod 3 and the functioning of the detection module 2 will now be explained in greater detail. The rod 3 can occupy three distinct main axial positions, particularly a first stable position as illustrated in FIG. 5*a*, a second stable position as illustrated in FIG. 5*b*, and an unstable end position, also called the 'click position,' which is illustrated in FIG. 5*c*. In order to reach these three main positions, the rod 3 typically passes through unstable secondary positions. In this example, the first stable position is an intermediate position or rest position, that is, this position is not related to any function of the watch, whereas the second stable position of the rod enables the hands of the watch to be manipulated, for example. The end position corresponds to a push function that can be used to activate a function of the watch, such as a chronograph or the displaying of the date.

In the rest position, the rod 3 is positioned/held in place by the two stem springs 25 that are inserted into the first groove of the rod. In this position, the blade is slightly deformed, with only a small amount of force of the return spring 11 acting on it. In addition, in this rest position, the first and second electrical contacts 7, 9 are open (not in contact with the blade 5).

If a user pulls the rod 3 outward from the rest position, that is, extends the rod, it reaches the second stable position (pulled position) as shown on FIG. 5*b*. In this position, the rod 3 is positioned/held in place by the two stem springs 25 that are inserted into the secured groove. The mechanical force then exerted on the blade in this pulled position is small, but not zero, whereby contact with the electrical contact 9 is ensured. In order to limit the deformation force on the blade when the rod withdraws from the rest position to the pulled position, the blade pivots at its first end under the action of the return spring 11 and finally comes into contact with the second electrical contact 9. The pivot axis is located at the first end of the blade 5, which comprises a bend at this location. This bend is positioned between a projecting portion of the substantially circular frame arranged inside the bend and a shoe so as to achieve the desired articulation. This particular arrangement makes it possible, firstly, for the blade to be held laterally in the frame 15 and, secondly, for it to pivot.

The end position of the rod can be reached by pushing the rod toward the inside of the watch by exerting a relatively large amount of force on it. As shown in FIG. 5*c*, in the end position, the blade 5 is designed to come into contact with the first electrical contact 7, which is flexible so that it is able to absorb a certain amount of pressure from the blade 5. In the end position, the second end of the blade 5 bears against a stop of the frame and the blade 5 exhibits relatively pronounced elastic deformation, since its central portion is pressed by the shoulder 6 of the rod in the defined direction from the pulled position to the end position. The return force in the end position is supplied primarily by the blade 5 and secondarily by the stem springs 25. The click sensation is ensured by the action of the springs 25 coming out of the second groove of the rod 3. For this purpose, the second groove comprises a double slope in the aforementioned direction with a steep section 27 and a gently sloping section 29 (clearly visible in FIG. 5*b*). In order to achieve a maximum return force with a minimum space requirement, the blade 5 has variable sections in order to distribute the stresses in the most appropriate manner possible. In particular, a provision is made that the central portion has the greatest width so that it remains sufficiently rigid, with the rod pressing on this central portion. It should be noted that, in the example shown, the blade does not pivot substantially between the rest position and the end position.

To summarize, the electronic detection module 2 thus comprises the curved elastic conductive blade 5, which is arranged in the frame 15 of the detection module 2, and two electrical contacts 7, 9, which are arranged so as to come into contact with the conductive plate in the pulled position and the end position of the rod, respectively. The first electrical contact 7 is arranged on the downstream side of the blade 5 relative to a defined direction from the pulled position toward its end position, while the second electrical contact 9 is arranged on the upstream side thereof. Advantageously, the curved elastic blade is mounted so as to pivot at its first end when the rod passes from the rest position to the pulled position, and vice versa. In particular, this pivoting is generated by the return spring 11 when the shoulder 6 of the rod is withdrawn. Preferably, this pivoting is performed substantially without elastic deformation of the blade 5, while the blade 5 is designed to undergo relatively substantial elastic deformation during the passage of the rod between the rest position and the end position in order to participate substantially to the restoring force of this rod to the rest position upon release of the axial activation force exerted thereon by a user. More specifically, the blade comprises a first intermediate portion between the central portion and the first end and a second intermediate portion between the central portion and the second end, with the blade also having a variable cross section that decreases from its central portion toward its first end and also toward its second end, so that the elastic deformation of the blade is concentrated substantially in its first and second intermediate parts, which are respectively located between the central portion and the two ends, when the rod passes between the intermediate position and the end position. Advantageously, the conductive blade has a variable cross section that decreases from its center toward its two ends so as to enable relatively substantial deformation of the two intermediate portions of the blade 5 located between its central portion and its first and second ends.

The present invention thus proposes an electronic detection module of reduced size in order to achieve a smaller bulk while including means for detecting three axial positions and means for effectively returning the rod from its end position after actuation thereof by a user for the push function upon release of the axial force exerted by the user.

What is claimed is:

1. A control device, comprising:

a user-actuatable rod; and an electric detector configured to detect a plurality of distinct axial positions of the rod, which defines a longitudinal axis and is displaceable axially, with the detector including:

an elastic conductive blade including a first end, a second end, and a central portion between the first end and the second end, with the blade being embodied such that the central portion is substantially perpendicular to the longitudinal axis of the rod and can be displaced axially by the rod, and such that it can occupy three distinct positions in order to enable detection of a pulled position, an end position, and an intermediate position of the rod, respectively, between the pulled position and the end position, a first electrical contact that is designed to come into contact with the blade only when the rod is in the end position, and a second electrical contact that is designed to come into contact with the blade only when the rod is in the pulled position, wherein the blade is designed to pivot at the first end when the rod passes from the intermediate position to the pulled position and vice versa, and the blade is designed to undergo elastic deformation when the rod passes between the intermediate position and the end position so as to participate substantially in a restoring force of the rod toward the intermediate position when an axial actuating force applied to the rod by a user is released.

2. The control device as set forth in claim 1, wherein the blade has a curved shape in an absence of a deformation force.

3. The control device as set forth in claim 2, wherein, in the absence of a deformation force, the blade has substantially a shape of a crossbow, and in a non-deformed state, the central portion is situated in projection on the longitudinal axis of the rod to a side of the pulled position relative to the first end and the second end.

4. The control device as set forth in claim 1, wherein the blade comprises a first intermediate portion between the central portion and the first end and a second intermediate portion between the central portion and the second end, and the blade has a variable cross section that decreases from the central portion toward the first end and the second end, so that the elastic deformation of the blade is concentrated substantially in first and second intermediate parts when the rod passes between the intermediate position and the end position.

5. The control device as set forth in claim 1, wherein the first electrical contact is arranged at the first end of the blade on a downstream side thereof relative to a defined direction from the pulled position toward the end position.

6. The control device as set forth in claim 1, wherein the second electrical contact is arranged at the second end of the blade on the upstream side thereof relative to a defined direction from the pulled position toward the end position.

7. The control device as set forth in claim 1, wherein the detector further includes a return spring that is engaged with the second end of the blade in order to bring about the pivoting of the blade.

8. The control device as set forth in claim 7, wherein the return spring is arranged on the downstream side of the second end of the blade relative to a defined direction from the pulled position toward the end position.

9. The control device as set forth in claim 7, wherein the return spring is an electrical conductor that is designed to apply an electric potential on the blade.

10. The control device as set forth in claim 1, wherein a pivoting of the blade between the intermediate position and the pulled position is performed substantially without elastic deformation of the blade.

11. The control device as set forth in claim 1, wherein the blade comprises a hole that passes through the central portion and into which the rod is inserted, with the rod comprising a shoulder against which a central blade abuts at least when the rod is displaced from the intermediate position toward the end position.

12. A timepiece comprising the control device as set forth in claim 1, wherein the rod constitutes a control member for several functions of the timepiece.

* * * * *